US007156626B2

(12) United States Patent
Park et al.

(10) Patent No.: US 7,156,626 B2
(45) Date of Patent: Jan. 2, 2007

(54) DOUBLE SIDE ACTION TYPE RECIPROCATING COMPRESSOR

(75) Inventors: Jung-Sik Park, Seoul (KR); Eon-Pyo Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 473 days.

(21) Appl. No.: 10/171,545

(22) Filed: Jun. 17, 2002

(65) Prior Publication Data

US 2003/0072658 A1 Apr. 17, 2003

(30) Foreign Application Priority Data

Oct. 12, 2001 (KR) ..... 2001-63138
Jan. 26, 2002 (KR) ..... 2002-4669

(51) Int. Cl.
*F04B 19/00* (2006.01)

(52) U.S. Cl. ..... 417/417; 417/487

(58) Field of Classification Search ..... 417/486, 417/487, 488
See application file for complete search history.

(56) References Cited

U.S. PATENT DOCUMENTS 717,750 A * 1/1903 Johnston ..... 417/488
3,791,770 A * 2/1974 Farkos ..... 417/418
5,630,401 A * 5/1997 Binversie et al. ..... 123/495
5,720,415 A * 2/1998 Morningstar ..... 222/1
6,079,960 A * 6/2000 Funatsu et al. ..... 417/488
6,089,352 A * 7/2000 Kim et al. ..... 184/6.16
6,129,527 A * 10/2000 Donahoe et al. ..... 417/416
6,231,310 B1 * 5/2001 Tojo et al. ..... 417/44.1
6,328,544 B1 * 12/2001 Kawahara et al. ..... 417/416
6,499,972 B1 * 12/2002 Yatsuzuka et al. ..... 417/417
6,644,943 B1 * 11/2003 Lilie et al. ..... 417/418
2001/0051099 A1 * 12/2001 Yatsuzuka et al. ..... 417/417

FOREIGN PATENT DOCUMENTS

JP 9-170552 A 6/1997
KR 1020000038305 * 7/2000
KR 1020000046839 * 7/2000

* cited by examiner

*Primary Examiner*—Anthony D. Stashick
*Assistant Examiner*—Samuel E. Belt
(74) *Attorney, Agent, or Firm*—Birch, Stewart, Kolasch, and Birch, LLP

(57) ABSTRACT

A double side action type reciprocating compressor is provided. The double side action type reciprocating compressor includes suction valve assemblies and discharge valve assemblies loaded in a suction passage and a discharge passage to thus control suction of fluid and respectively combined with each other so that movement direction of fluid flowing inside the suction valve assemblies and the discharge valve assemblies is vertical to the movement direction of the reciprocating motor. Accordingly, it is possible to remove the suction passage and the suction valve directly formed or loaded in the piston. Therefore, it is possible to easily process the pistons. Because the diameter and the length of the pistons can be reduced, it is possible to miniaturize the compressor. Also, because the suction valve and the discharge valve are positioned on a side surface with respect to the movement direction of the pistons, it is possible to prevent the pistons from colliding with each other and to prevent the valves from being damaged. Also, because the left and right pistons share the same compression space when the pistons are in a reciprocating motion. The forward and the backward of the pistons move keeping balance. Accordingly, the compressor stably drives regardless of movement conditions.

3 Claims, 8 Drawing Sheets

DOUBLE SIDE ACTION TYPE RECIPROCATING COMPRESSOR

BACKGROUND OF THE INVENTION

1. Field of the Invention

The present invention relates to a double side action type reciprocating compressor, and more particularly, to a double side action type reciprocating compressor including a suction/discharge system, which is suitable for manufacturing the compressor to be extremely small.

2. Description of the Background Art

In general, a double side action type reciprocating compressor is a high efficiency and low vibration compressor, where two compression units are combined with the respective reciprocating motors and are arranged to face each other in a casing.

As shown in FIG. 1, the conventional double side action type reciprocating compressor includes a cylindrical casing 10 including a suction pipe (SP) and a discharge pipe (DP) on both sides in a radial direction, a first reciprocating motor 21 and a second reciprocating motor 22 loaded on both sides inside the casing 10 in a longitudinal direction, a cylinder 30 loaded between the two reciprocating motors 21 and 22 in a long diameter direction, a first piston 41 and a second piston 42 inserted into both sides of the cylinder 30 to slide in a direction of a long diameter so that the respective leading ends of the first and second pistons 41 and 42 face each other and combined with moving magnets 21B and 22B of the reciprocating motors 21 and 22, a first suction valve assembly 51 and a second suction valve assembly 52 respectively combined with the leading ends of the pistons 41 and 42 so as to face each other, and a first discharge valve 61 and a second discharge valve 62 loaded so as to open and close the discharge side of the cylinder 30.

The cylinder 30 is ring-shaped and includes a through hole 31 in a reciprocating direction of the pistons 41 and 42 so that the pistons 41 and 42 are inserted into the cylinder 30 to slide, to thus form compression spaces S1 and a discharge space S2. A suction passage 32 whose section is T-shaped is formed on one side outer circumference so that the outlet end of the suction passage 32 is connected to suction passages 41*a* and 42*a* of the pistons 41 and 42 through an inner space of the casing 10. A discharge passage 33 whose inlet end is connected to the discharge space S2 and whose section is I-shaped is formed on the opposite side outer circumference.

The first piston 41 and the second piston 42 are combined with the moving magnets 21B and 22B of the first reciprocating motor 21 and the second reciprocating motor 22. The suction passages 41*a* and 42*a* are penetratingly formed in a reciprocating motion direction of the motors 21 and 22 in the middle of the pistons 41 and 42.

As shown in FIG. 3, the first suction valve assembly 51 and the second suction valve assembly 52 include a first valve housing 51A and a second valve housing 52A including suction holes 51*a* and 52*a* connected to the suction passages 41*a* and 42*a* of the pistons 41 and 42 and fit-pressingly fixed to the leading ends of the pistons 41 and 42 and a first suction valve 51B and a second suction valve 52B inserted into the inner space of the valve housings 51A and 52A to slide, the first suction valve 51B and the second suction valve 52B for selectively opening and closing the suction passages 41*a* and 42*a* of the pistons 41 and 42 and the suction holes 51*a* and 52*a* of the valve housings 51A and 52A according to the reciprocating motion of the pistons 41 and 42.

The first discharge valve 61 and the second discharge valve 62 are installed between the compression spaces S1 and the discharge space S2 so as to open and close the compression spaces S1 of the cylinder 30. The pressure back surfaces of the discharge valves 61 and 62 are supported by a valve spring 63.

Among reference numerals that are not described, 21A and 22A are a first stator and a second stator and 71 and 72 are a first resonance spring and a second resonance spring.

The operation of the conventional double side action type reciprocating compressor will now be described.

When power is applied to the reciprocating motors 21 and 22, the pistons 41 and 42 are in a linear reciprocating motion in the through hole 31 of the cylinder 30 and a refrigerant gas is received into both side suction pressure regions (not shown), that is, the space inside the casing 10 along the suction pipe (SP) and the suction passage 32 of the cylinder 30.

The refrigerant gas is received into the compression spaces S1 of the cylinder 30 along the suction passages 41*a* and 42*a* of the pistons 41 and 42 and is compressed, and then is discharged to the discharge space S2 due to the continuous reciprocating motion of the first piston 41 and the second piston 42. The compressed gas of the discharge space S2 is discharged to a system outside the casing 10 through the discharge passage 33 and the discharge pipe (DP) during the next discharge stroke of the pistons 41 and 42.

To be more specific, as shown in FIG. 2, when the pistons 41 and 42 move to be far from each other, the refrigerant gas filled in the suction pressure regions of the casing 10 is sucked up into the compression spaces S1 of the cylinder 30 through the suction passages 41*a* and 42*a* while pushing the suction valves 51B and 52B of the pistons 41 and 42. At this time, because the pressure of the compression spaces S1 is lower than the pressure of the suction space, such as a suction pipe (SP) and an interior of the case 10, the first discharge valve 61 and the second discharge valve 62 close the discharge side of the cylinder 30.

As shown in FIG. 3, when the pistons 41 and 42 move to be closer to each other, the pressure of the compression spaces S1 becomes higher than the pressure of the discharge space S2. Accordingly, the discharge valves 61 and 62 that fill up the compression spaces S1 of the cylinder 30 are opened. At the same time, the compressed refrigerant gas is received into the discharge space S2. Accordingly, the compressed refrigerant gas of the discharge space S2 is discharged to the outside of the compressor. At this time, the suction valve 51B fills up the suction passages 41*a* and 42*a* of the pistons 41 and 42 because the pressure of the compression spaces S1 is higher than the pressure inside the casing 10.

However, according to the conventional double side action type reciprocating compressor, when the suction passages 41*a* and 42*a* are formed in the pistons 41 and 42 and the suction valve assemblies 51 and 52 are loaded in the ends of the suction passages 41*a* and 42*a* or when the suction valve assemblies 51 and 52 are loaded in the leading ends of the pistons 41 and 42, it is difficult to manufacture the suction valve assemblies 51 and 52 suitable for the pistons 41 and 42 having a small diameter and to load the suction valves 51B and 52B in the pistons 41 and 42. Accordingly, productivity deteriorates. Also, during the reciprocating motion of the pistons 41 and 42, the suction valve assemblies 51 and 52 collide with the first discharge valve 61 and the second discharge valve 62 or deviate from the pistons 41 and 42. Accordingly, the suction valve assemblies 51 and 52 can be damaged.

Also, according to the characteristics of the compressor, the pistons 41 and 42 that are moving objects must be precisely processed. Portions to be precisely processed such as a valve settling place increase in the pistons 41 and 42. As a result, it is more difficult to process the pistons 41 and 42.

Also, because the discharge valve assemblies 51 and 52 are positioned in front of the pistons 41 and 42, the length of the entire apparatus becomes longer.

Also, because the plurality of compression spaces S1 exist and the respective compression spaces S1 are opened and closed by the linear reciprocating motion of the pistons 41 and 42 combined with the motors 21 and 22, when there is something wrong with the electrical control of the motors 21 and 22, the pressures of the compressed compression spaces S1 become unbalanced. So, the motion of the compressor would be unstable. Accordingly, from side to side vibration of the compression apparatus is accelerated.

SUMMARY OF THE INVENTION

Therefore, an object of the present invention is to provide a double side action type reciprocating compressor that can be miniaturized by reducing the length of a compression part.

Another object of the present invention is to provide a double side action type reciprocating compressor, which is capable of easily manufacturing and loading suction valve assemblies and of preventing discharge valves from deviating or colliding with each other, to thus be damaged, during an operation.

Another object of the present invention is to provide a double side action type reciprocating compressor, which is capable of easily manufacturing pistons to be precisely processed.

Another object of the present invention is to provide a double side action type reciprocating compressor, which is capable of stabilizing a system by suppressing a phenomenon that pistons are pushed backward during the operation of the compressor.

To achieve these and other advantages and in accordance with the purposes of the present invention, as embodied and broadly described herein, there is provided a double side action type reciprocating compressor, comprising a casing, on both sides a suction pipe and a discharge pipe are connectedly installed, a plurality of reciprocating motors installed on both sides inside the casing and generating a reciprocating motion in opposite directions, a cylinder loaded on the inner circumference of the casing so as to be positioned in a space between the reciprocating motors, a plurality of pistons combined to moving magnets interposed between slits of the reciprocating motors and inserted into a through hole formed in the cylinder to slide, suction valve assemblies loaded in a suction passage of the cylinder to thus control suction of fluid and combined with each other so that movement direction of fluid flowing inside the suction valve assemblies is formed to be vertical to movement direction of the reciprocating motors, and discharge valve assemblies loaded in a discharge passage of the cylinder to thus control discharge of fluid and combined with each other so that movement direction of fluid flowing inside the discharge valve assemblies is formed to be vertical to movement direction of the reciprocating motors.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

A double side action type reciprocating compressor according to the present invention will now be described in detail with reference to an embodiment shown in the attached drawings.

Figure 1:
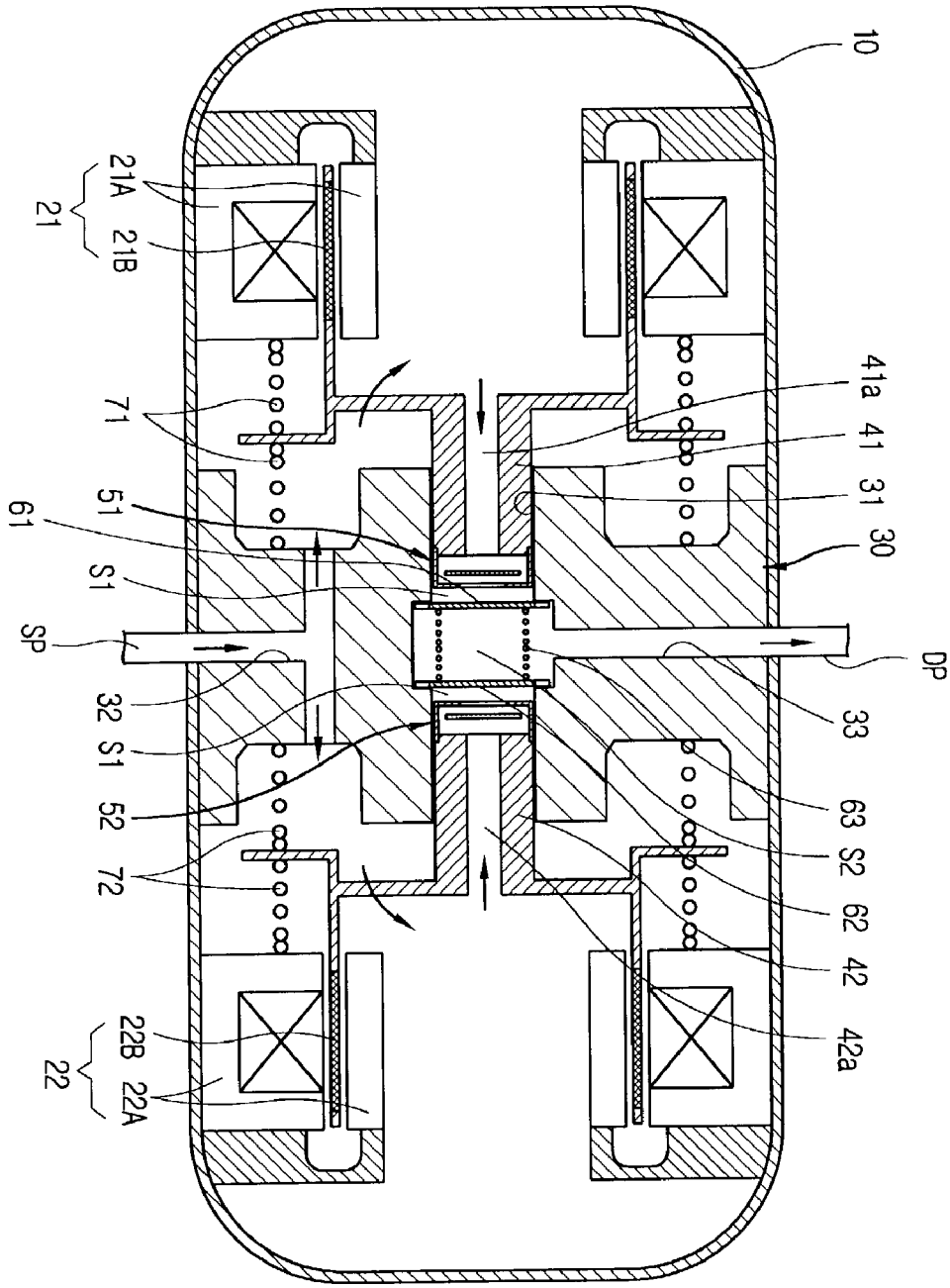
FIG. 1 CONVENTIONAL ART
FIG. 1 is a vertical sectional view showing an example of a conventional double side action type reciprocating compressor.
Figure 2:
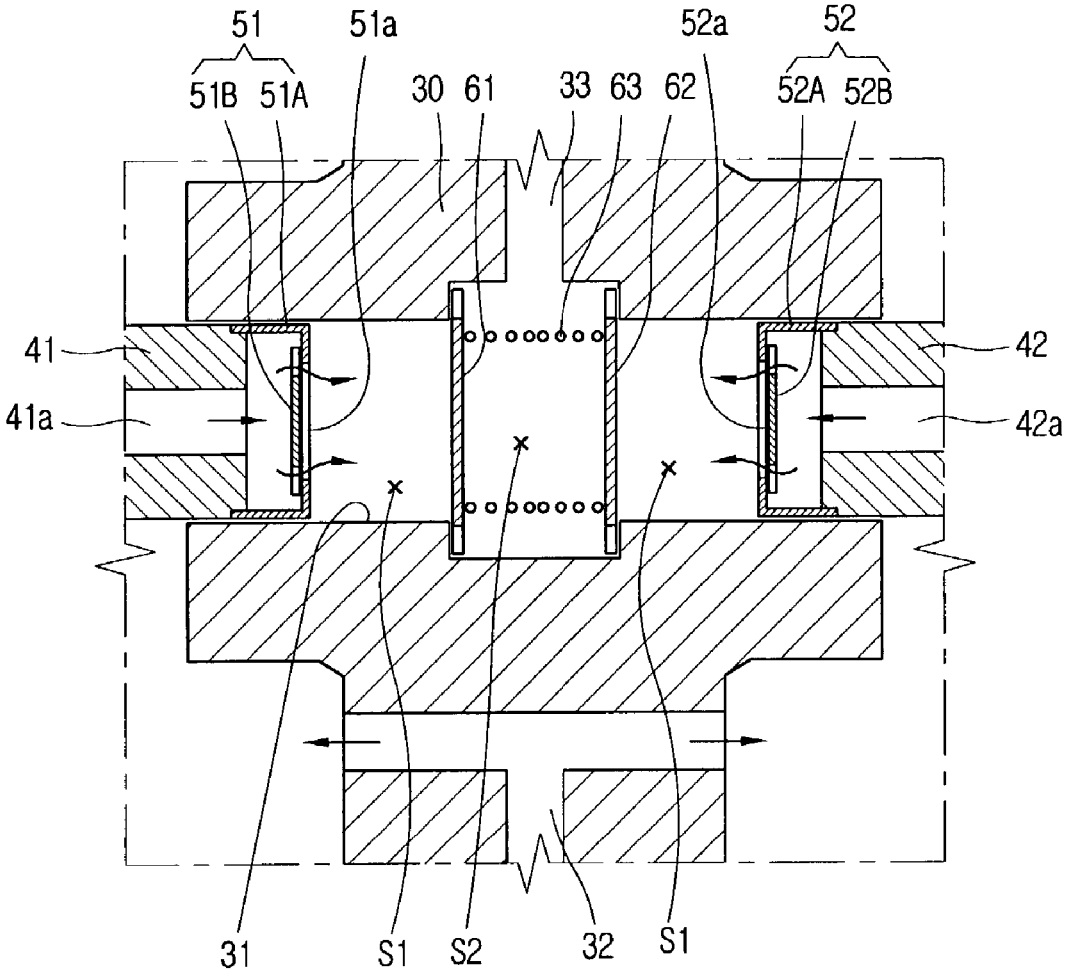
FIG. 2 CONVENTIONAL ART
FIG. 2 schematically shows the suction stroke of the conventional double side action type reciprocating compressor.
Figure 3:
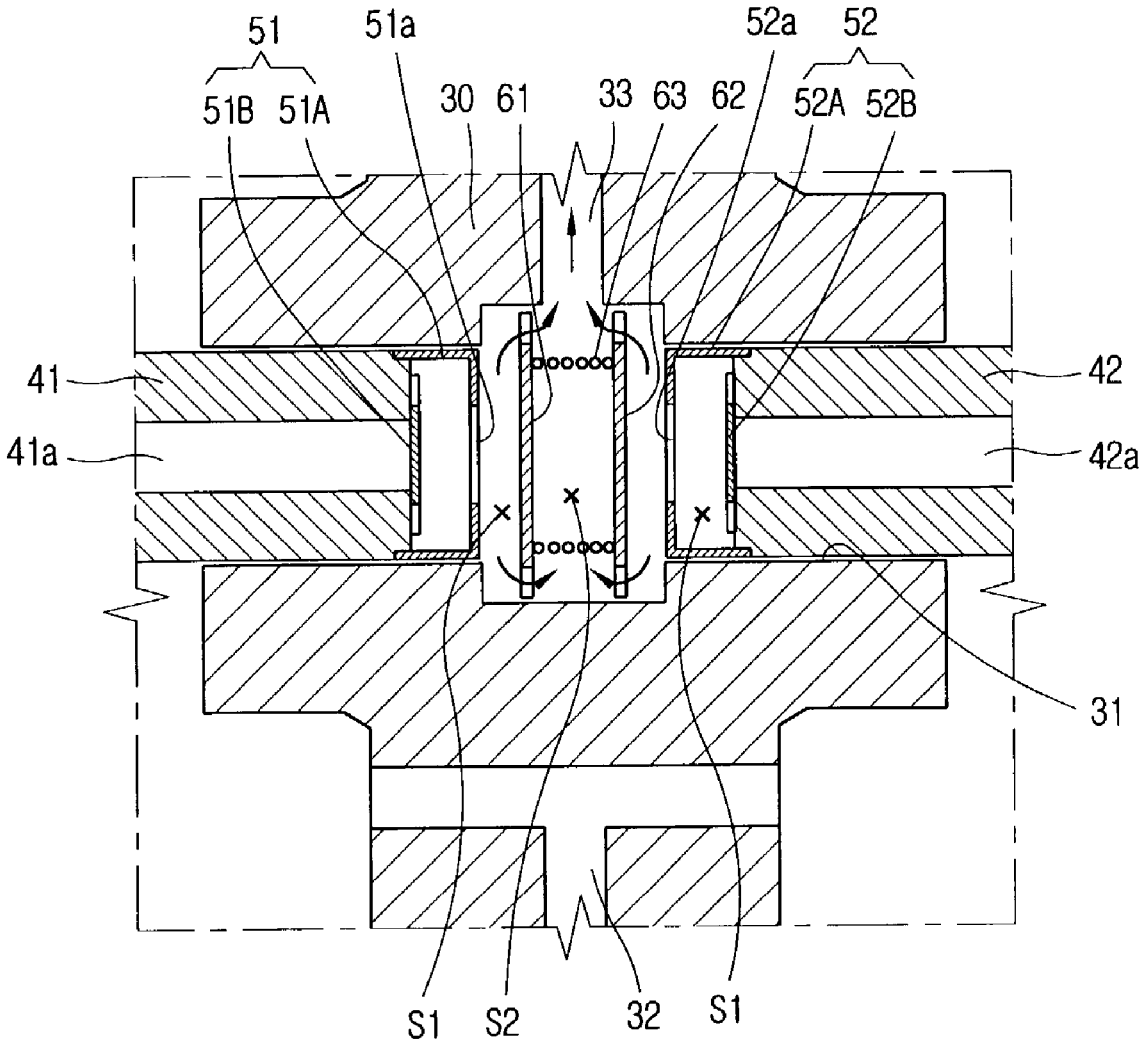
FIG. 3 CONVENTIONAL ART
FIG. 3 schematically shows the discharge stroke of the conventional double side action type reciprocating compressor.
Figure 4:
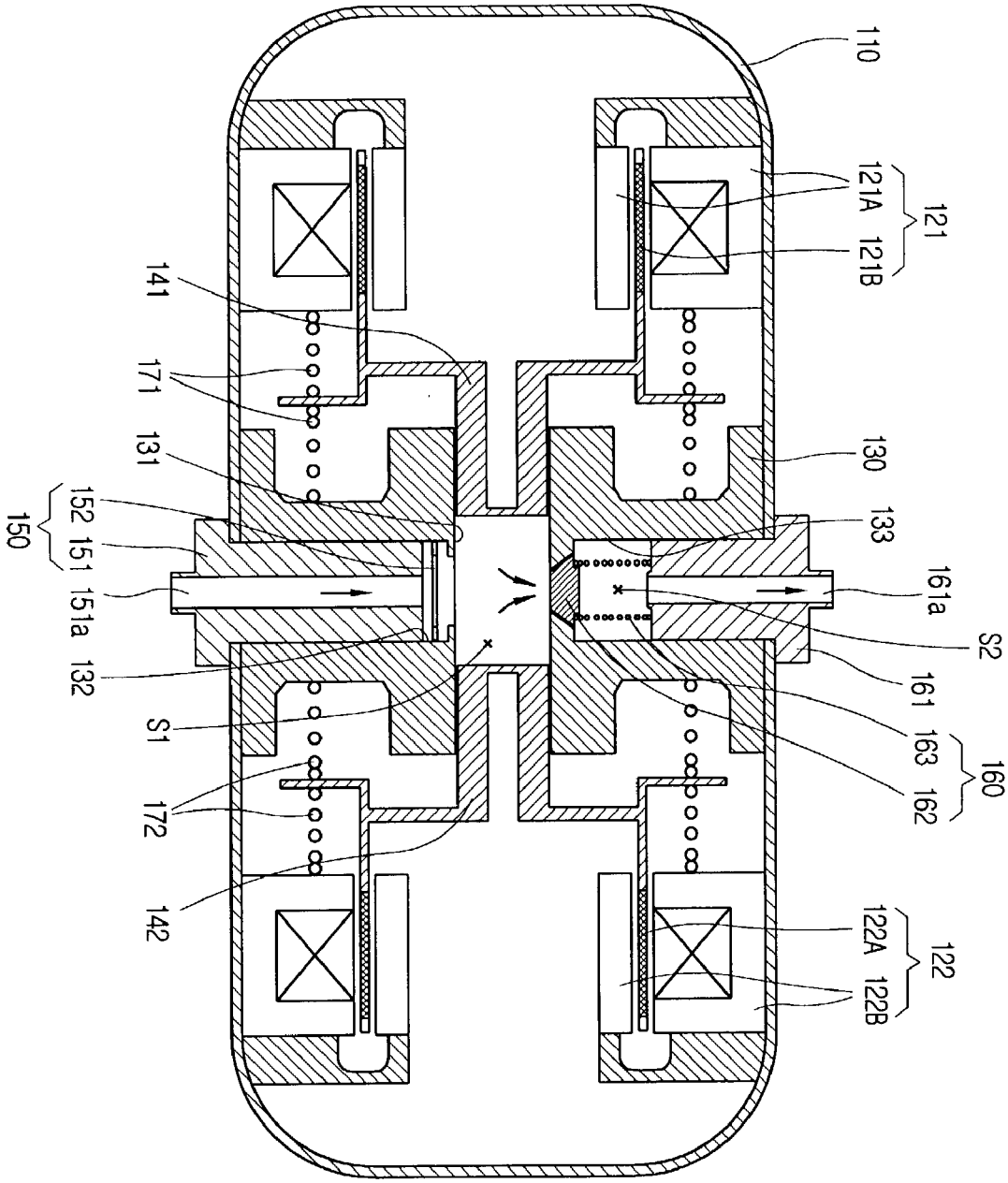
FIG. 4 is a vertical sectional view showing an example of a double side action type reciprocating compressor according to the present invention.
Figure 5:
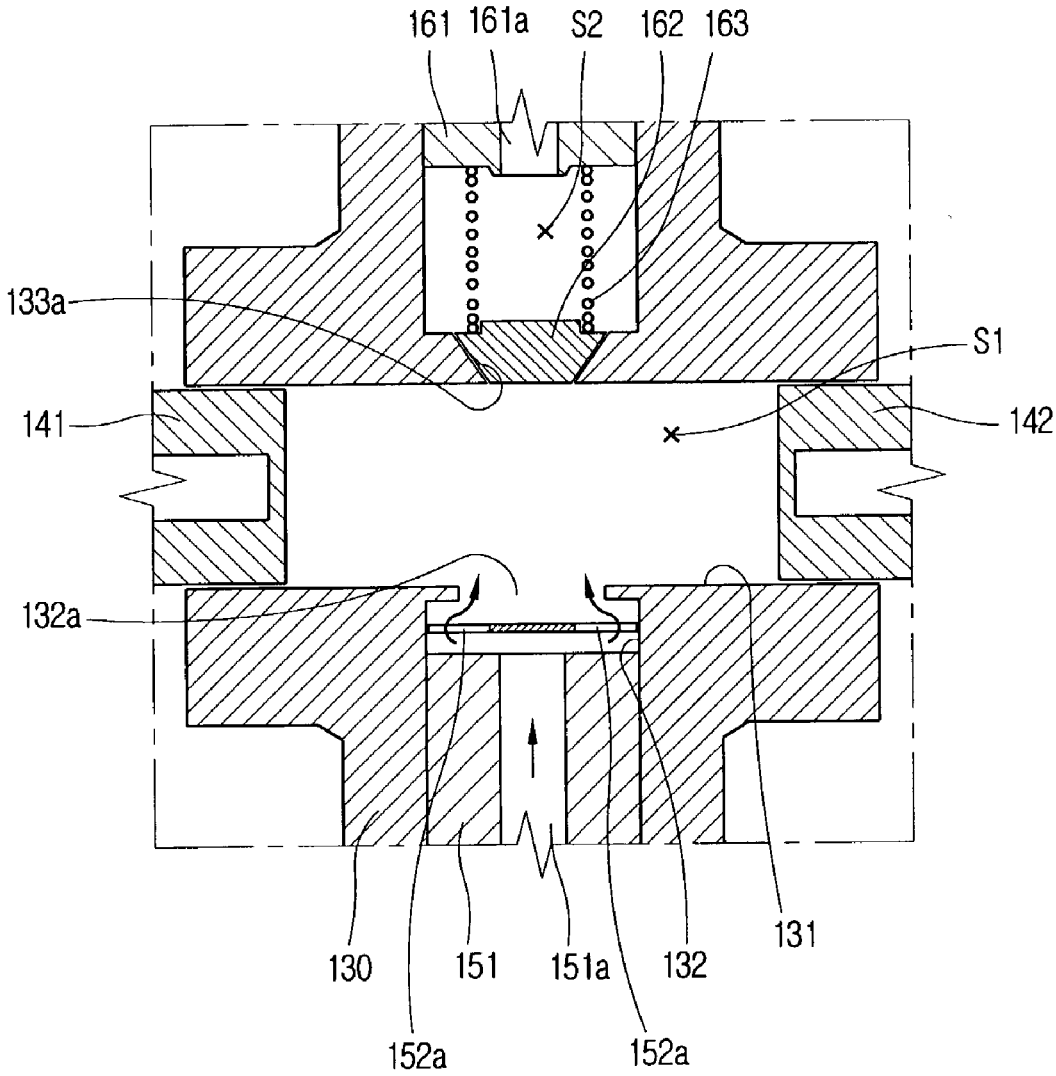
FIG. 5 schematically shows the suction stroke of the double side action type reciprocating compressor according to the present invention.
Figure 6:
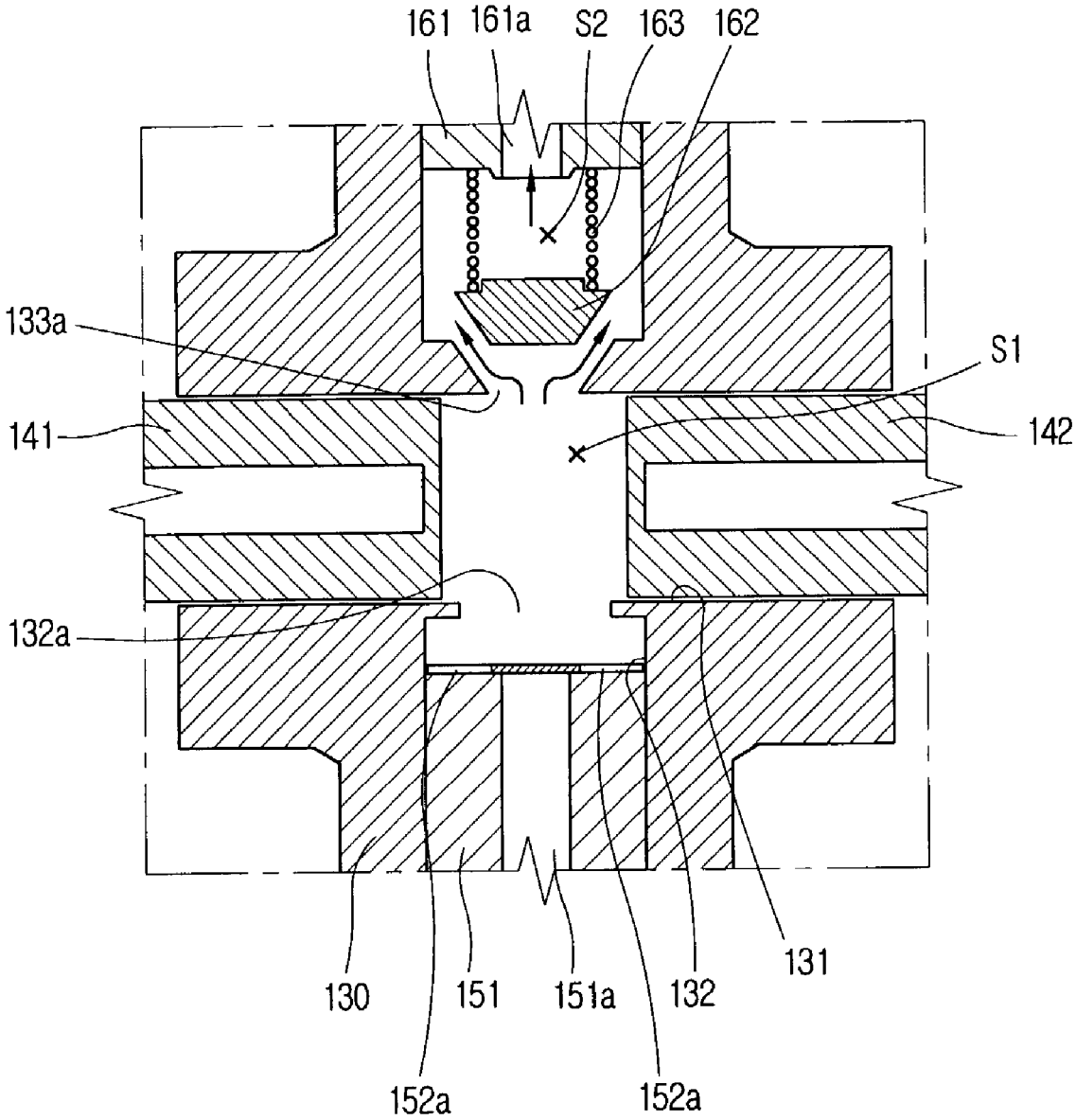
FIG. 6 schematically shows the discharge stroke of the double side action type reciprocating compressor according to the present invention.

FIG. 4 is a vertical sectional view showing an example of a double side action type reciprocating compressor according to the present invention. FIGS. 5 and 6 schematically show the suction stroke and the discharge stroke of the double side action type reciprocating compressor according to the present invention.

As shown in FIGS. 4 through 6, the double side action type reciprocating compressor according to the present invention includes a casing 110, to which a suction pipe (not shown) and a discharge pipe (not shown) are connected in a radial direction of the casing 110, a first reciprocating motor 121 and a second reciprocating motor 122, which are installed on both sides of the casing 110 and whose moving magnets 121B and 122B are in a reciprocating motion in opposite directions, a cylinder 130 loaded between the first reciprocating motor 121 and the second reciprocating motor 122, including a compression space S1 penetratingly formed in a direction coaxial to the reciprocating motors 121 and 122, and independently including a suction passage 132 and a discharge passage 133 connected to the compression space S1, a first piston 141 and a second piston 142 combined with the moving magnets 121B and 122B of the first reciprocating motor 121 and the second reciprocating motor 122 and inserted into a through hole 131 formed inside the cylinder 130 to slide so that the leading ends of the first and second pistons 141 and 142 face each other, a suction valve assemblies 150 loaded in the suction passage 132 of the cylinder 130, the suction valve assemblies 150 for controlling the suction of fluid, and a discharge valve assembly 160 loaded in the discharge passage of the cylinder 130, the discharge valve assembly 160 for controlling the discharge of fluid.

The cylinder 130 is formed to be integrated with the casing 110 so that the outer circumference of the cylinder 130 is attached to the inner circumference of the casing 110 or is manufactured to be separated from the casing 110. The cylinder 130 can be fixed to the inner circumference in the middle of the casing 110 by welding or bolting.

The through hole 131 is formed in the cylinder 130 in a reciprocating motion direction of the pistons 141 and 142 so that the pistons 141 and 142 are inserted into the cylinder 130 to slide, to thus form the compression space S1. The suction passage 132 is formed so that the compression space S1 is connected to the suction pipe (not shown). The discharge passage 133 is formed so that the compression space S1 is connected to the discharge pipe (not shown).

Stepped surfaces (no references) are formed in the inside ends of the suction passages 132 and the discharge passage 133 of the cylinder 130 so that a suction valve 152 and a discharge valve 162 to be mentioned later are placed.

The first piston 141 and the second piston 142 are preferably in the form of empty cylinders, whose ends are closed, so as to reduce weights.

The suction valve assemblies 150 includes a suction adapter 151 including a suction hole 151*a* connected to the suction pipe (not shown) and press-fitted to the suction passage 132 and a suction valve 152 positioned in the leading end of the suction hole 151*a* and inserted into the inner circumference of the suction passage 132 to slide, the suction valve 152 for opening and closing the suction hole 151*a*.

The diameter of the suction hole 151*a* of the suction adapter 151 is formed to be smaller than the diameter of the inside end of the suction passage 132.

The suction valve 152 is in the form of a disk, on whose outer circumference several gas suction grooves 152*a* are included. A virtual circle that connects the inner circumferences of the gas suction grooves 152*a* to each other is formed to have a diameter larger than the diameter of the suction hole 151*a* and smaller than the inner diameter of the inside end of the suction passage 132.

The discharge valve assembly 160 includes a discharge adapter 161 including a discharge hole 161*a* so as to be connected to the discharge pipe (not shown) and press-fitted to the discharge passage 133 of the cylinder 130, a discharge valve 162 elastically supported by the leading end of the discharge adapter 161, the discharge valve 162 for opening and closing the inside end of the discharge passage 133, and a valve spring 163 loaded between the pressure back surface of the discharge valve 162 and the leading end of the discharge adapter 161, the valve spring 163 for supporting the discharge valve 162.

The discharge adapter 161 is preferably inserted into the cylinder 130 so as to be separated from the inside end of the discharge passage 133 of the cylinder 130 so that a discharge space S2 holding the discharge valve 162 and the valve spring 163 is formed inside the discharge passage 133.

The discharge valve 162 forms a pressure surface inserted into the discharge passage 133, a pressure back surface wider than the discharge passage 133, and a tilted sealing surface (no reference) between the pressure surface and the pressure back surface, to thus form a tapered cone whose head portion is cut off. The inside end of the discharge passage 133 corresponding to the cone includes a stepped surface (no reference). A tilted sealing surface (no reference) is formed at the edge of the stepped surface so as to contact the sealing surface (no reference) of the discharge valve 162.

Another embodiment of the discharge valve assembly will now be described.

Figure 7:
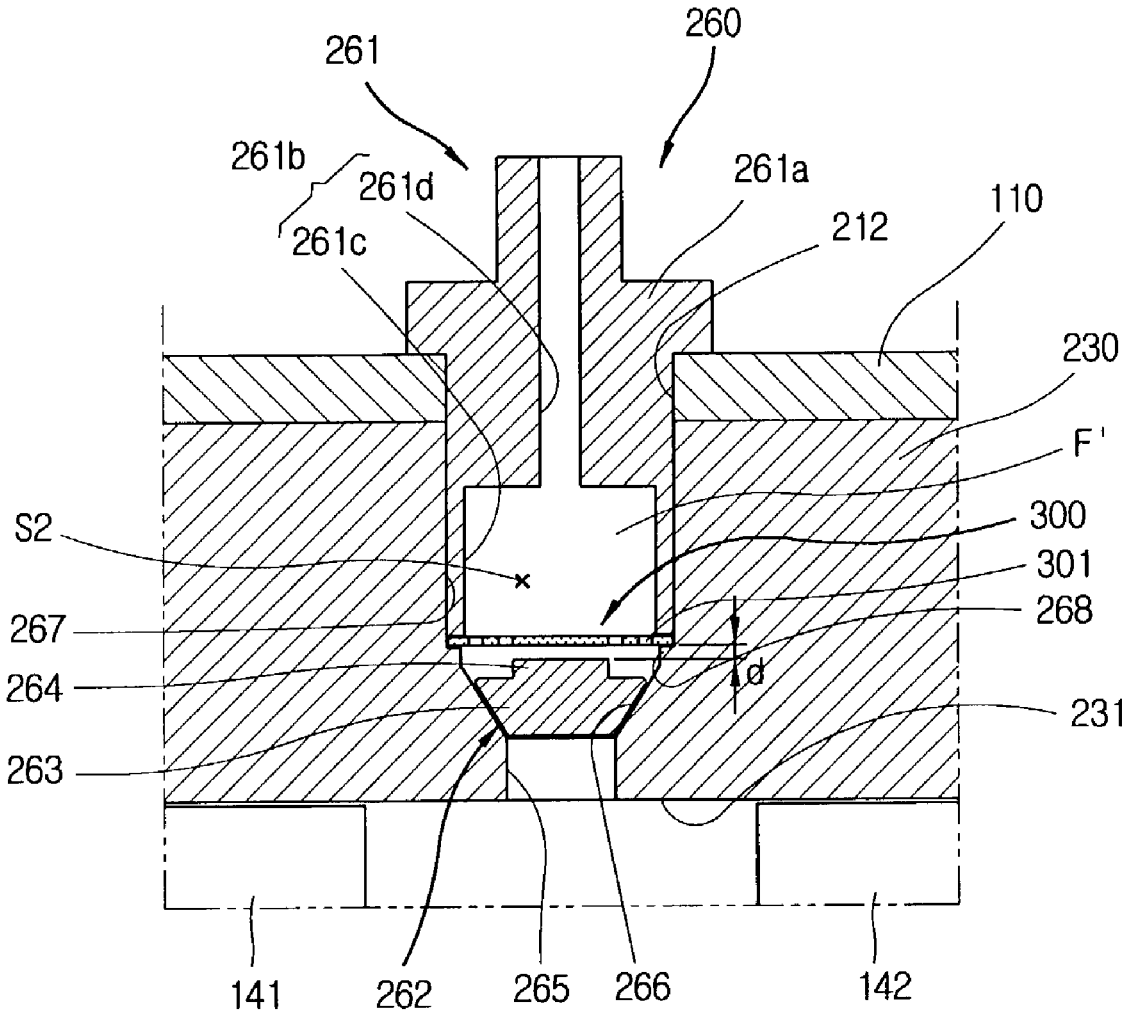
FIG. 7 is an enlarged sectional view showing another embodiment of a discharge valve assembly of the double side action type reciprocating compressor according to the present invention.
Figure 8:
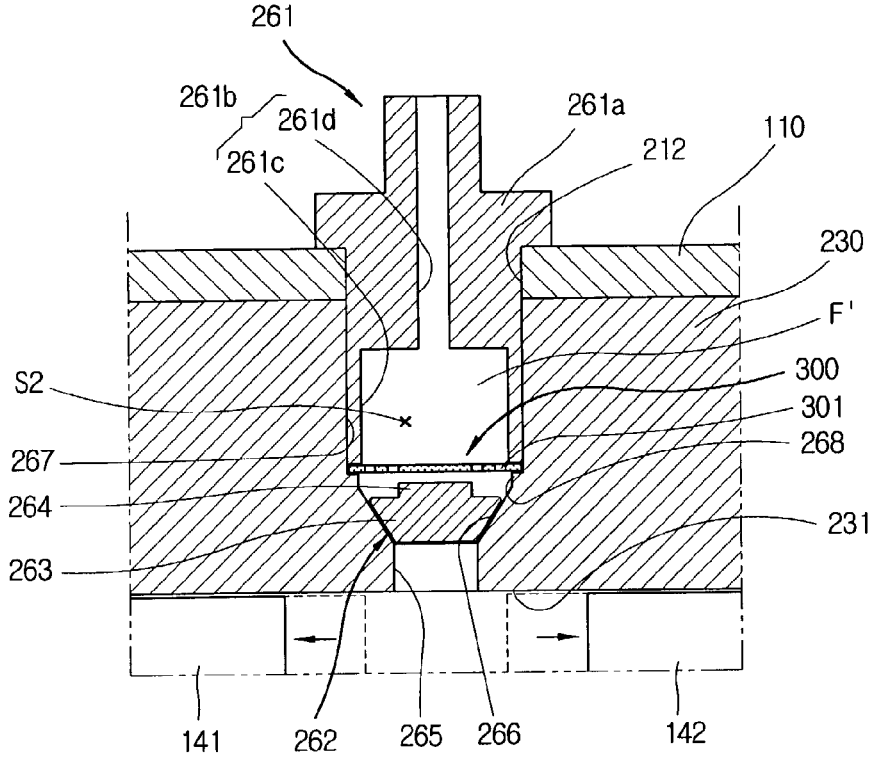
FIG. 8 schematically shows the suction stroke of another embodiment of the discharge valve assembly of the double side action type reciprocating compressor according to the present invention.
Figure 9:
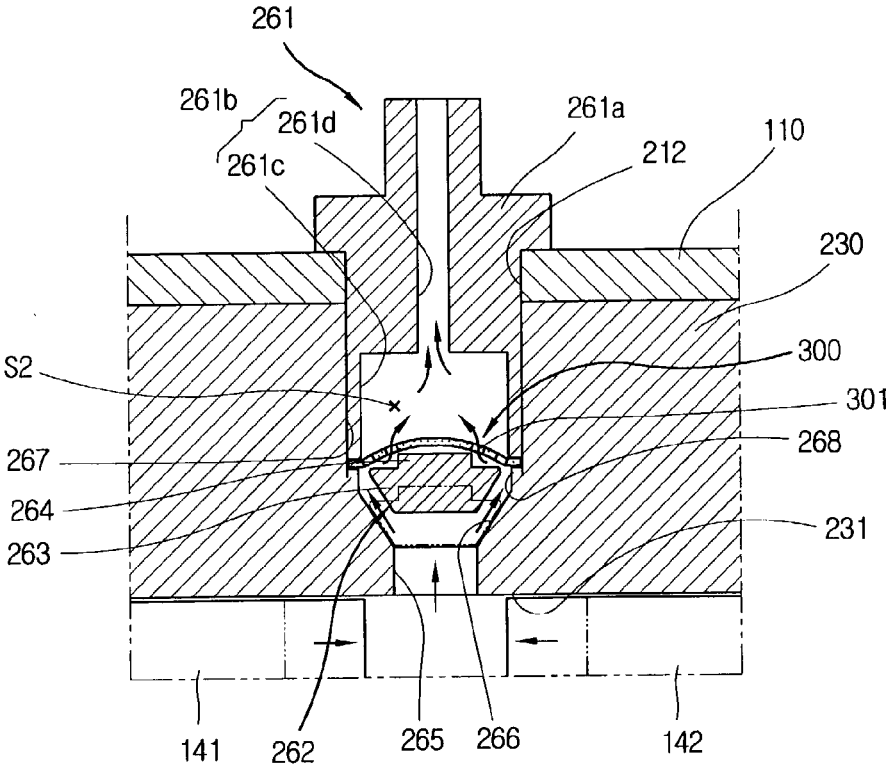
FIG. 9 schematically shows the discharge stroke of another embodiment of the discharge valve assembly of the double side action type reciprocating compressor according to the present invention.

FIG. 7 is an enlarged sectional view showing another embodiment of the discharge valve assembly of the double side action type reciprocating compressor according to the present invention. FIGS. 8 and 9 schematically show the suction stroke and the discharge stroke of another embodiment of the discharge valve assembly of the double side action type reciprocating compressor according to the present invention.

As shown in FIGS. 7 through 9, according to another embodiment 260 of the discharge valve assembly 160, a plate spring 300 is used instead of a valve spring 163 in the form of a coil unlike in the previous embodiment, to thus improve abrasion resistance and responsibility of the valve.

A cylinder 230 of a predetermined form is fixedly combined with the inside of the casing 110. A through hole 231 is formed in the middle of the cylinder 230. The first piston 141 and the second piston 142 are inserted into both sides of the through hole 231 to slide.

A discharge passage F' having the discharge space S2 is formed so as to be connected to the through hole 231 formed inside the cylinder 130.

The discharge passage F' includes a first holes 265 formed to have predetermined inner diameter and depth on the inner wall of the cylinder through hole 231, a tilted stepped sealing surface 266 formed to have a predetermined depth in the form of a cone so as to be extended to the first hole 265, and a second hole 267 formed to have an inner diameter larger than the long diameter of the tilted stepped sealing surface 266 so as to be connected to a through hole 212 formed in the casing 110 to be connected to the tilted stepped sealing surface 266.

The discharge passage F' formed of the first hole 265, the tilted stepped sealing surface 266, and the second hole 267 is formed in a direction perpendicular to the cylinder through hole 231 of the frame.

An inertial discharge valve 262 in the form of a cone whose head portion is cut off is inserted into the discharge passage F'.

The discharge valve 262 includes a cone 263 whose head portion is cut off so as to correspond to the tilted stepped sealing surface 266 of the discharge passage F' and a supporter 264 protruding so as to have predetermined outer diameter and height in the middle of the long diameter of the cone 263. The outer circumference of the cone 263 forms a sealing surface.

The discharge adapter 261 including a discharge hole 261*b* inside thereof is inserted into the second hole 267 of the discharge passage F' of the cylinder 230 and is combined with the cylinder 230.

The discharge adapter 261 includes a body 261*a* having predetermined outer diameter and length and inserted into and fixed to the discharge passage F' and a discharge hole 261*b* penetratingly formed in the body 261*a*.

The discharge hole 261*b* includes a first inner diameter 261*c* formed so as to have predetermined depth and diameter in the end positioned inside the discharge passage F' and a second inner diameter 261*d* penetratingly formed so as to have an inner diameter smaller than the first inner diameter 261*c* to be connected to the first inner diameter 261*c*.

The plate spring 300 is combined with the inside of the discharge passage F' so that the plate spring 300 is separated from the discharge valve 262 by a predetermined distance d during the suction stroke of the pistons 141 and 142.

A plurality of through grooves 301, in which refrigerant gas can flow during the movement of the discharge valve 262, are formed in a thin circular thin plate in the plate spring 300.

The diameter of a virtual circle formed in the inner circumference of the through grooves 301 is formed to be larger than the diameter of the supporter 264 formed in the discharge valve 262.

The discharge valve 262 is supported by the plate spring 300 after moving a predetermined distance during the discharge stroke of the pistons 141 and 142.

Also, in the plate spring 300, a stepped portion 268 is formed on the inner circumference of the discharge passage F', that is, on the inner circumference of the second hole 267 of the discharge passage F'. The plate spring 300 is fixed to and combined with the end of the discharge adapter 261 inserted into and combined with the discharge passage F' in a state of being positioned in the stepped portion 268.

As a matter of course, it is well known that the compressor can be operated even without the springs 163 and 300 in the discharge valve assemblies 160 and 260.

Among reference numerals that are not described, 121A and 122A are a first stator and a second stator and 171 and 172 are a first resonance spring and a second resonance spring.

The operation and effect of the double side action type reciprocating compressor according to the present invention will now be described.

When power is applied to the first reciprocating motor 121 and the second reciprocating motor 122, the first piston 141 and the second piston 142 are simultaneously in a linear reciprocating motion in opposite directions in the through hole 131 of the cylinder 130. At the same time, refrigerant gas is discharged to a system outside the casing 110 through the suction pipe (not shown), the suction hole 151*a* of the suction adapter 151, the discharge passage 133 of the cylinder 130, the discharge adapter 161, and the discharge pipe (not shown).

To be more specific, as shown in FIG. 5, when the pistons 141 and 142 move to be far from each other, the refrigerant gas outside the casing 110 is received through the suction pipe (not shown) and the suction hole 151*a* of the suction adapter 151, pushes the suction valve 152 positioned in the leading end of the suction adapter 151, connects the suction hole 151*a* to the suction passage 132, and is sucked up into the compression space S1 of the cylinder 130.

At this time, the suction valve 152 is attached to the stepped surface of the suction passage 132. However, because the diameter of a virtual circle connecting the gas suction grooves 152*a* of the suction valve 152 to each other is smaller than the diameter of the suction hole 132*a*, the refrigerant gas is received into the compression space S1 of the cylinder 130 through the gas suction grooves 152*a* and stays in the compression space S1.

As shown in FIG. 6, when the first piston 141 and the second piston 142 move to be closer to each other, the pressure of the refrigerant gas of the compression space S1 is increased to more than a predetermined discharge pressure. Accordingly, the refrigerant gas opens the discharge valve 162 and is discharged to the discharge pipe (not shown) through the discharge hole 133*a*, the discharge passage 133, and the discharge hole 161*a* of the discharge adapter 161.

The discharge valve 162 is pushed while being supported by the valve spring 163, pushes the compressed refrigerant gas filled in the discharge space S2 to the discharge hole 161*a* of the discharge adapter 161, and lets the compressed refrigerant gas discharged to the discharge pipe (not shown). The suction valve 151 is pushed to the compressed gas and is attached to the leading end of the suction adapter 151. However, because the diameter of the suction hole 151*a* of the suction adapter 151 is smaller than the diameter of the virtual circle connecting the inner circumferences of the gas suction grooves 152*a* of the suction valve 152 to each other, back flow of the compressed gas is prevented.

As the suction valve assemblies are loaded in the suction passage of the cylinder, it is possible to easily manufacture and install the suction valve. Also, because the suction valve assemblies are loaded in a fixed body but not in moving pistons, it is possible to prevent the suction valve assemblies from deviating or colliding with each other, to thus be damaged.

It is possible to easily process the pistons because a suction passage is not formed in the pistons and the additionally combined suction valve assemblies are not loaded.

It is possible to suppress a phenomenon where the pistons are pushed backward with excessive displacement during the operation of the pistons because intermediate pressure is formed between suction pressure and discharge pressure by refrigerant leaking between the cylinder and the piston backward both pistons.

Because both pistons share the compression, pressures backward the pistons, which affect the movement of the pistons, are the same as each other. Accordingly, it is possible to reduce the vibration of the compressor.

The operation and the effect of another embodiment 260 of the discharge valve assemblies 160 of the reciprocating compressor according to the present invention will now be described.

As shown in FIG. 8, when the first piston 141 and the second piston 142 simultaneously move to be far from each other, the outer circumference of a cone 263 of the inertial discharge valve 262 whose head is cut off is attached to the tilted stepped sealing surface 266 of the discharge passage F' by difference in pressures inside the cylinder through hole 231. Accordingly, the discharge passage F' is closed.

The refrigerant gas outside the casing 110 is received through the suction pipe (not shown) and the suction hole 151*a* of the suction adapter 151, pushes the suction valve 152 positioned in the leading end of the suction adapter 151, connects the suction hole 151*a* to the suction passage 132, and is sucked up into the compression space S1 of the cylinder 130.

The suction valve 152 is attached to the stepped surface of the suction passage 132. However, the diameter of a virtual circle connecting the gas suction grooves 152*a* of the suction valve 152 to each other is smaller than the diameter of the suction hole 132*a*. Accordingly, the refrigerant gas is received into the compression space S1 of the cylinder 130 through the gas suction grooves 152*a* and stays in the compression space S1.

When the first piston 141 and the second piston 142 simultaneously move to be closer to each other, as shown in FIG. 9, the refrigerant gas sucked up into the through hole 231 of the cylinder 130 is gradually compressed. The inertial discharge valve 262 moves due to difference in pressure between the compression space S1 formed by the ends of the first piston 141 and the second piston 142 and the through hole 231 and a discharge side. Accordingly, clearance is generated between the sealing surface of the discharge valve 262 and the tilted stepped sealing surface 266 of the discharge passage F'.

When the inertial discharge valve 262 firstly moves, the inertial discharge valve 262 is opened in a state of not being supported by the plate spring 300. When the inertial discharge valve 262 moves by a more than predetermined distance, the inertial discharge valve 262 is elastically supported by the plate spring 300 and moves.

When clearance is generated between the sealing surface of the inertial discharge valve 262 and the tilted stepped sealing surface 266, the compressed refrigerant gas leaks from the compression space S1 and is discharged through the discharge hole 261*b* formed in the discharge adapter 261.

When the first piston 141 and the second piston 142 move to be far from each other, the inertial discharge valve 262 moves by difference in pressures of the compression space S1 and the sealing surface of the inertial discharge valve 262 is attached to the tilted stepped sealing surface 266 of the discharge passage F'. Accordingly, the discharge passage F' is closed and the refrigerant gas is sucked up into the compression space S1 again.

The inertial discharge valve 262 elastically moves in a state of being elastically supported by the plate spring 300. After the inertial discharge valve 262 moves more than a predetermined distance, the inertial discharge valve 262 freely moves and is settled in the tilted sealing stepped surface 266.

Therefore, the plate spring 300 is loaded to be separated from the inertial discharge valve 262 by a predetermined distance, the discharge valve 262 is not affected by the plate spring 300 at the point of time where the inertial discharge valve 262 is closed, that is, the sealing surface of the inertial discharge valve 262 and the tilted stepped sealing surface 266 of the discharge passage F' are settled.

Also, the discharge valve 262 is not affected by the plate spring 300 even at the point of time where the discharge valve 262 is opened, that is, the sealing surface of the discharge valve 300 is separated from the tilted stepped sealing surface 266 of the discharge passage F'. Accordingly, the discharge passage F' is correctly opened and closed. It is possible to prevent parts from being abraded and the responsibility of the discharge valve becomes excellent.

According to the double side action type reciprocating compressor of the present invention, the suction valve assemblies and the discharge valve assemblies including the suction valve and the discharge valve connected to the compression space formed in the middle of the cylinder are formed on both sides of the cylinder. Accordingly, the refrigerant gas is received to the compression space through the suction passage without passing through the inside of the casing and is discharged through the discharge passage. Therefore, because the suction passage directly formed in the pistons and the suction valve loaded in the pistons are removed, it is possible to easily process the pistons. Also, because the length of the compression apparatus can be reduced, it is possible to reduce the size of the entire compressor.

Also, the suction adapter and the discharge adapter are included, it is possible to easily manufacture the suction valve and the discharge valve. Because the suction valve and the discharge valve are loaded in the fixed body such as the suction/discharge adapter, it is possible to prevent the suction valve and the discharge valve from deviating or colliding with each other, thus to be damaged.

Because the intermediate pressure between the suction pressure and the discharge pressure is formed backward both pistons by the refrigerant leaking between the cylinder and the pistons, the left and right pistons are balanced during the reciprocating motion of the left and right pistons. Accordingly, it is possible to suppress the phenomenon where the backward of the piston is pushed. Because the pistons share the compression space, the motions of both pistons are the same. Accordingly, it is possible to reduce the vibration of the compressor. Since, the piston is supported by intermediate pressure, the average position of the piston can be more close to the initial position than no intermediate pressure exists. It leads to the high volumetric dfficiency.

Also, because abrasion between the discharge passage, through which the refrigerant gas is discharged, and the discharge valve for opening and closing the discharge passage is suppressed, the discharge passage and the discharge valve are correctly settled. Accordingly, it is possible to prolong the life of parts and the sealing stroke of the parts is improved. Also, the responsibility of the discharge valve becomes excellent, it is possible to improve the opening and closing strokes of the discharge passage and to improve the reliability of the compressor.

What is claimed is:

1. A double side action reciprocating compressor, comprising:

a casing having a suction pipe and a discharge pipe operatively connected to the casing at a first radial side and a second radial side of the casing with respect to a length of the casing;

a first reciprocating motor being installed at a first side of the casing, said first reciprocating motor generating a first horizontal reciprocating motive force;

a second reciprocating motor being installed at a second side of the casing, said second reciprocating motor generating a second horizontal reciprocating motive force parallel and opposite to the first horizontal reciprocating motive force;

a cylinder being integrally formed in an inner circumference of the casing in a space between the reciprocating motors;

a first piston and a second piston operatively connected with respective moving magnets interposed between slits of the reciprocating motors and inserted into a through hole formed in the cylinder to permit a sliding motion therein responsive to the first and second horizontal motive forces, respectively to compress a working fluid;

a suction valve assembly being positioned in a suction passage of the cylinder to operatively control a suction flow of fluid through the suction passage, wherein said suction flow of fluid is perpendicular to the first and second horizontal reciprocating motive forces of the reciprocating motors; and a discharge valve assembly being positioned in a discharge passage of the cylinder to operatively control a discharge flow of fluid through the discharge passage, wherein said discharge flow of fluid is perpendicular to the first and second horizontal reciprocating motive forces of the reciprocating motors, wherein the suction valve assemblies further comprise:

a suction adapter including a suction hole connected to the suction pipe and press-fitted with the suction passage formed in the cylinder; and a disk-shaped suction valve positioned in a space formed between the leading end of the suction adapter and the suction hole, and wherein the suction valve is in the form of a disk including several gas suction grooves on the outer circumference of the suction valve and the diameter of a virtual circle connecting the inner circumference of the gas suction groove is formed to be smaller than the inner diameter of the inside end of the suction passage.

2. A double side action reciprocating compressor, comprising:

a casing having a suction pipe and a discharge pipe operatively connected to the casing at a first radial side and a second radial side of the casing with respect to a length of the casing;

a first reciprocating motor being installed at a first side of the casing, said first reciprocating motor generating a first horizontal reciprocating motive force;

a second reciprocating motor being installed at a second side of the casing, said second reciprocating motor generating a second horizontal reciprocating motive force parallel and opposite to the first horizontal reciprocating motive force;

a cylinder being integrally formed in an inner circumference of the casing in a space between the reciprocating motors;

a first piston and a second piston operatively connected with respective moving magnets interposed between slits of the reciprocating motors and inserted into a through hole formed in the cylinder to permit a sliding motion therein responsive to the first and second horizontal motive forces, respectively to compress a working fluid;

a suction valve assembly being positioned in a suction passage of the cylinder to operatively control a suction flow of fluid through the suction passage, wherein said suction flow of fluid is perpendicular to the first and second horizontal reciprocating motive forces of the reciprocating motors; and a discharge valve assembly being positioned in a discharge passage of the cylinder to operatively control a discharge flow of fluid through the discharge passage, wherein said discharge flow of fluid is perpendicular to the first and second horizontal reciprocating motive forces of the reciprocating motors wherein the discharge valve assembly includes:

a discharge hole connected to the discharge pipe;

a discharge adapter press-fitted with the discharge passage formed in the cylinder; and a discharge valve elastically supported by the leading end of the discharge adapter, the discharge valve for opening and closing the discharge hole formed inside end of the discharge passage;

an elastic device positioned in a space formed between the leading end of the discharge adapter and the discharge hole, wherein the elastic device is a disk-shaped plate spring and wherein the plate spring is separated from the discharge valve by a predetermined distance.

3. A double side action reciprocating compressor, comprising:

a casing having a suction pipe and a discharge pipe operatively connected to the casing at a first radial side and a second radial side of the casing with respect to a length of the casing;

a first reciprocating motor being installed at a first side of the casing, said first reciprocating motor generating a first horizontal reciprocating motive force;

a second reciprocating motor being installed at a second side of the casing, said second reciprocating motor generating a second horizontal reciprocating motive force parallel and opposite to the first horizontal reciprocating motive force;

a cylinder being integrally formed in an inner circumference of the casing in a space between the reciprocating motors;

a first piston and a second piston operatively connected with respective moving magnets interposed between slits of the reciprocating motors and inserted into a through hole formed in the cylinder to permit a sliding motion therein responsive to the first and second horizontal motive forces, respectively;

a suction valve assembly being positioned in a suction passage of the cylinder to operatively control a suction flow of fluid through the suction passage, wherein said suction flow of fluid is perpendicular to the first and second horizontal reciprocating motive forces of the reciprocating motors;

a discharge valve assembly being positioned in a discharge passage of the cylinder to operatively control a discharge flow of fluid through the discharge passage, wherein said discharge flow of fluid is perpendicular to the first and second horizontal reciprocating motive forces of the reciprocating motors;

a through hole being formed in a center of the cylinder for forming a compression space and so as to be parallel to the first and second horizontal reciprocating motive forces of the reciprocating motors, wherein the suction passage and the discharge passage are respectively formed in a direction perpendicular to a direction where the through hole is formed so as to be operatively connected to the compression space;

a stepped surface formed in the end of the discharge passage connected to the compression space; and a discharge hole tapered toward a side of the compression space is formed at the edge of the stepped surface so that a diameter of the discharge hole is smaller than a diameter of a remaining portion of the discharge passage.

* * * * *